US009038349B2

(12) United States Patent
Fox

(10) Patent No.: US 9,038,349 B2
(45) Date of Patent: May 26, 2015

(54) KEDER RAIL ATTACHMENT FOR A FABRIC/PANEL BUILDING

(71) Applicant: Benjamin D. Fox, South Haven, MN (US)

(72) Inventor: Benjamin D. Fox, South Haven, MN (US)

( * ) Notice: Subject to any disclaimer, the term of this patent is extended or adjusted under 35 U.S.C. 154(b) by 0 days.

(21) Appl. No.: 14/095,921

(22) Filed: Dec. 3, 2013

(65) Prior Publication Data

US 2015/0020473 A1 Jan. 22, 2015

Related U.S. Application Data

(60) Provisional application No. 61/856,221, filed on Jul. 19, 2013.

(51) Int. Cl.

| | |
|---|---|
| ***E04B 1/00*** | (2006.01) |
| ***E04D 5/14*** | (2006.01) |
| ***E04H 15/32*** | (2006.01) |
| ***E04H 15/64*** | (2006.01) |

(52) U.S. Cl.

CPC ..... *E04D 5/146* (2013.01); *E04H 15/322* (2013.01); *E04H 15/644* (2013.01)

(58) Field of Classification Search

CPC ..... E04H 15/646; E04H 15/322; E04H 4/108; E04B 9/303; E04B 2009/0492; E04B 2002/7479; F16B 5/0692; E04F 13/005; E04F 10/02; E04F 13/00; E04F 13/0814; Y10S 135/907; Y10S 160/07

See application file for complete search history.

(56) References Cited

U.S. PATENT DOCUMENTS

| | | | | |
|---|---|---|---|---|
| 1,991,358 | A | | 2/1935 | Bessy |
| 2,102,902 | A | | 12/1937 | Lenke |
| 2,189,567 | A | | 2/1940 | Miller |
| 2,247,846 | A | | 7/1941 | Perlman |
| 2,287,667 | A | | 6/1942 | Brown |
| 2,296,782 | A | * | 9/1942 | Fischer et al. ..... 403/335 |
| 2,950,727 | A | | 8/1960 | Dunn |
| 3,173,224 | A | | 3/1965 | Aagaard |
| 3,875,623 | A | | 4/1975 | Johnston |
| 3,930,344 | A | | 1/1976 | Gahler |
| 3,982,361 | A | | 9/1976 | Deutsch et al. |
| 4,036,244 | A | * | 7/1977 | Huddle ..... 52/63 |
| 4,118,904 | A | * | 10/1978 | Sprung ..... 52/63 |
| 4,137,687 | A | | 2/1979 | Sprung |
| 4,214,407 | A | * | 7/1980 | Charter ..... 52/63 |
| 4,214,411 | A | * | 7/1980 | Pickett ..... 52/144 |
| 4,229,914 | A | * | 10/1980 | Lucas ..... 135/124 |
| 4,321,780 | A | | 3/1982 | Hooper et al. |
| 4,546,584 | A | * | 10/1985 | Mieyal et al. ..... 52/281 |
| 4,571,897 | A | * | 2/1986 | Kerr ..... 52/13 |
| 4,583,331 | A | * | 4/1986 | Hunt et al. ..... 52/2.17 |
| 4,593,710 | A | * | 6/1986 | Stafford et al. ..... 135/136 |
| 4,644,706 | A | * | 2/1987 | Stafford et al. ..... 52/63 |
| 4,817,655 | A | * | 4/1989 | Brooks ..... 135/121 |
| 4,841,688 | A | * | 6/1989 | Rinaldi ..... 52/63 |
| 4,878,322 | A | | 11/1989 | Ikeda et al. |
| 4,885,877 | A | * | 12/1989 | Hunt et al. ..... 52/63 |

(Continued)

*Primary Examiner* — Brian Glessner
*Assistant Examiner* — Gisele Ford
(74) *Attorney, Agent, or Firm* — Albert W. Watkins

(57) ABSTRACT

An extrudable keder rail and a clamping anchor for the keder rail are cooperative to secure keder fabric to a building support beam. The clamping anchor allows the keder rail to be securely attached to a standard beam without drilling holes or strapping about the beam. A temporary clamp and movable tensioning device allow the keder rails and keder fabric to be applied to the building support beams after the support beams have been assembled and installed.

6 Claims, 6 Drawing Sheets

(56) References Cited

U.S. PATENT DOCUMENTS

| | | | | |
|---|---|---|---|---|
| 5,209,029 | A * | 5/1993 | Foerst | 52/63 |
| 5,269,106 | A * | 12/1993 | Stafford et al. | 52/63 |
| 5,333,425 | A | 8/1994 | Nickerson et al. | |
| 5,408,770 | A * | 4/1995 | Suzuki | 38/102 |
| 5,784,842 | A | 7/1998 | Wackerbauer | |
| 5,823,704 | A | 10/1998 | Koch et al. | |
| 5,953,875 | A * | 9/1999 | Harkins | 52/407.3 |
| 6,158,181 | A | 12/2000 | Musgrave et al. | |
| 6,474,022 | B1 * | 11/2002 | Double et al. | 52/3 |
| 6,564,513 | B2 | 5/2003 | Henbid et al. | |
| 6,789,978 | B1 * | 9/2004 | Yoshinari | 403/381 |
| 6,904,720 | B1 * | 6/2005 | Adolfson et al. | 52/63 |
| 7,127,851 | B2 | 10/2006 | Morris | |
| 8,051,868 | B2 | 11/2011 | Whitlow | |
| 8,056,602 | B1 | 11/2011 | Green | |
| 8,079,187 | B2 * | 12/2011 | Greiner | 52/222 |
| 8,245,464 | B2 * | 8/2012 | Saiz et al. | 52/222 |
| 8,327,565 | B2 * | 12/2012 | Boltz et al. | 40/603 |
| 8,572,928 | B2 * | 11/2013 | Bruder | 52/775 |
| 8,851,096 | B2 * | 10/2014 | De Villenfagne De Sorinnes et al. | 135/122 |
| 8,893,417 | B2 * | 11/2014 | Miller et al. | 40/617 |
| 2003/0163966 | A1 | 9/2003 | Reynolds et al. | |
| 2004/0168383 | A1 | 9/2004 | Reynolds et al. | |
| 2006/0080919 | A1 * | 4/2006 | Dykstra et al. | 52/268 |
| 2006/0101730 | A1 * | 5/2006 | Sprung | 52/82 |
| 2006/0219373 | A1 * | 10/2006 | McKinney | 160/395 |
| 2008/0000056 | A1 * | 1/2008 | Murray | 24/460 |
| 2008/0142064 | A1 * | 6/2008 | Maraki | 135/121 |
| 2008/0263835 | A1 * | 10/2008 | Lapouge | 24/586.11 |
| 2010/0037544 | A1 | 2/2010 | Musgrave et al. | |

* cited by examiner

KEDER RAIL ATTACHMENT FOR A FABRIC/PANEL BUILDING

CROSS REFERENCE TO RELATED APPLICATIONS

This application claims the benefit of U.S. provisional patent application 61/856,221 filed Jul. 19, 2013 of the same title and inventorship as the present application, the entire contents which are incorporated herein by reference.

BACKGROUND OF THE INVENTION

1. Field of the Invention

This invention pertains generally to buildings, and more particularly to enclosures including flexible fabric surfacing. A fastening structure for the flexible fabric surfacing is preferably formed from an extrusion having a fabric receiving channel. A fabric edged with a fastener may be inserted within the channel. The fastener is larger than the channel opening, to retain the fabric and fastener within the channel.

2. Description of the Related Art

In the construction of buildings, fabric may be used as a covering or barrier layer that may at least in part define a roof or sides of the building. This offers a lightweight alternative to other construction materials, can be moved readily in temporary structures, and allows more permanent structures to be expanded easily. For the purposes of the present disclosure, fabric materials will be understood to include woven and non-woven fabrics, films, and similar sheets. These materials may be fabricated from a single homogenous material, or from various laminates, including those of like or diverse compositions. Different fabrics may be used in part of or forming an entire building to regulate air, light, and moisture flow through the space. Fabric with a thicker, tubular edge typically called keder is often used in these situations, and the edges need to be secured to the structure in some way. These can be secured using keder rails.

A number of United States patents, the teachings and contents which are incorporated herein by reference, are exemplary of these keder structures: U.S. Pat. No. 1,991,358 by Bessy, entitled "Awning fixture"; U.S. Pat. No. 2,102,902 by Lenke, entitled "Skylight construction"; U.S. Pat. No. 2,189,567 by Miller, entitled "Awning strip"; U.S. Pat. No. 2,247,846 by Perlman, entitled "Hanging means for awnings and the like"; U.S. Pat. No. 2,287,667 by Brown, entitled "Awning fastener"; U.S. Pat. No. 2,950,727 by Dunn, entitled "Support for flexible awning covers"; U.S. Pat. No. 5,823,704 by Koch et al, entitled "Holding device for the anchorage of single- or multilayer webs to a stationary structural member"; U.S. Pat. No. 6,564,513 by Henbid et al, entitled "Extrusion design and fabric installation method for weather tight seal"; U.S. Pat. No. 7,127,851 by Morris, entitled "Building component"; U.S. Pat. No. 8,051,868 by Whitlow, entitled "Tent rafter end cap and tent incorporating same"; U.S. Pat. No. 8,056,602 by Green, entitled "Screen cover retainer strip assembly"; 2003/0163966 by Reynolds et al, entitled "Method and apparatus for cladding elongated structural members"; and 2004/0168383 by Reynolds et al, entitled "Method and apparatus for cladding elongated structural members".

Many existing keder rails such as those listed herein above need to be attached into the structure's frame using a screw. While these aforementioned patents illustrate a variety of screws, a particularly popular screw currently in the trade is a TEK screw, explicitly illustrated in the aforementioned patent to Morris. Common TEK screws drill their own hole as they are being turned, and then they tap threads to couple the keder rail to the purlin, beam, frame or the like. As is known, TEK screws are relatively simple to install, only requiring a standard power drill. However, TEK screws can also easily strip a hole and are easily misaligned, particularly if they need removed and re-installed, making them more difficult to install and adjust than is desired. In addition, they are only capable of supporting a relatively limited load, in turn limiting the applications available for keder buildings. The hole formed by the TEK screw may form a weak point in the supporting structure, potentially leading to stress fractures or other adverse and weakening effects. Finally, the presence of any type of screw also means a hole exists that may initially or ultimately enable the intrusion of water and other potentially corrosive compositions into the building structure. The water or other corrosive agents can undesirably damage the building or the contents of the building. The present invention attempts to provide a more versatile keder rail attachment that preserves the moisture barrier where so desired.

Other patents illustrate bolting keder rails to structural members such as purlins, beams and the like. Exemplary US patents and published applications, the teachings and contents which are incorporated herein by reference, include: U.S. Pat. No. 3,173,224 by Aagaard, entitled "Roof structure"; U.S. Pat. No. 3,930,344 by Gahler, entitled "Plastic covered building structures"; U.S. Pat. No. 3,982,361 by Deutsch et al, entitled "Modified structure for lining generally curved surfaces"; U.S. Pat. No. 4,137,687 by Sprung, entitled "Stressed membrane space enclosure"; U.S. Pat. No. 6,158,181 by Musgrave et al, entitled "Roofing structures"; and 2010/0037544 by Musgrave et al, entitled "Covering apparatus". Once again, these structures undesirably require holes for the bolts to pass through, creating conduits for damaging flow and weaker structure adjacent to the hole.

Other techniques are used to fasten keder rails. Exemplary US patents and published applications, the teachings and contents which are incorporated herein by reference, include: U.S. Pat. No. 3,875,623 by Johnston, entitled "Fabric joints", which describes an unanchored bridging joint; U.S. Pat. No. 4,878,322 by Ikeda et al, entitled "Insulating plastic film structures and method", which describes a strap anchor about a support tube; and U.S. Pat. No. 5,784,842 by Wackerbauer, entitled "Roof arrangement comprising tarpaulins and a plurality of lattice girders", which describes a lattice girder having keder channels formed therein.

While somewhat less relevant hereto, the teachings and content of U.S. Pat. No. 4,321,780 by Hooper et al, entitled "Snap cap for architectural wall panel", are additionally incorporated herein by reference.

In the prior art keder structures, tension in the fabric is generally created by inserting the keder into a keder rail that is already attached to a component of the structure's frame and then moving the component and rail together until the proper amount of tension is achieved. This limits the techniques available for attaching the structural components together, since they must be both adjustable in position and must be installed with the fabric in place. In one alternative, the teachings and content which are incorporated herein by reference, U.S. Pat. No. 5,333,425 by Nickerson et al, entitled "Tension membrane structure wrinkle elimination", describes a multi-component structure that engages within a slot formed in the top of a support beam and allows the fabric to be tensioned after coupling to the support beam. Unfortunately, this Nickerson et al structure requires a plurality of extrusions where the prior art only required one, rendering the fabrication of the rail significantly more expensive. Additionally, a plurality of fasteners must be slid into position within the keder rail, requiring much additional time and thereby increasing the cost of installation. Nevertheless, the Nickerson et al invention offers much advantage over many of the prior art keder rails.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In contrast to the prior art, the present invention provides an improvement that allows the structure's frame to remain in place while the keder rail is moved, while avoiding the need for additional fabrication or installation expense, and while avoiding the need for undesirable holes in the rail or supporting structure.

In a first manifestation, the invention is, in combination, a keder rail, support beam and keder rail attachment. The keder rail comprises a base; two longitudinally open bodies each having one open slit extending in the longitudinal direction; and a longitudinally extensive slot between said two longitudinally open bodies. The keder rail attachment comprises a fastener affixed laterally through said keder rail base; and couplers extending between said fastener and said support beam.

In a second manifestation, the invention is a method of tensioning keder fabric upon an installed structural beam. According to the method, a first end of the keder fabric is anchored to a first structural support. At least two distal points along a keder rail are clamped to the installed structural beam. The keder fabric is engaged with the keder rail. A tensioning member is anchored to the installed structural beam. The tensioning member is coupled to the keder rail. A tension is generated between the tensioning member and keder rail, and responsive to generating this tension, the keder fabric is tensioned. Subsequent to generating the tension, the keder rail is secured to the structural beam.

In a third manifestation, the invention is a tensioning tool operative with a support I-beam for tensioning a keder rail having keder fabric engaged therewith and thereby tensioning the keder fabric. The tensioning tool has a flaccid strap terminating at a first end in a hook operative to engage the keder rail. A winch has a portion of the flaccid strap wrapped thereabout. A right angle brace bar has two orthogonal surfaces joined together, with a first orthogonal surface supporting the winch and operatively resting underneath a cross member of the I-beam, and a second of the two orthogonal surfaces operatively engaging a vertical of the support I-beam. The junction of the two orthogonal surfaces is adjacent to a junction between the I-beam cross member and I-beam vertical. An anchor tongue extends from the second orthogonal surface and is operative to removably couple to the I-beam vertical.

OBJECTS OF THE INVENTION

Exemplary embodiments of the present invention solve inadequacies of the prior art by providing an extrudable keder rail, a clamping anchor for the keder rail, and a tensioning device for use during the installation of the keder rail. The clamping anchor allows the keder rail to be securely attached to a standard beam without drilling holes or strapping about the beam.

A first object of the invention is to provide a fabric covering or barrier layer that may at least in part define a roof or sides of the building structure. A second object of the invention is to provide a lightweight alternative to other construction materials that can be installed quickly, moved readily when used for temporary structures, and that allows more permanent structures to be expanded easily. Another object of the present invention is to enable the selection of different fabrics that may be used in part of or forming an entire building to regulate air, light, and moisture flow through the space. A further object of the invention is to maintain the integrity of the barrier, by avoiding fastener holes. Yet another object of the present invention is to facilitate tensioning the fabric in place upon an assembled support structure, rather than upon the ground prior to installation of support beams.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
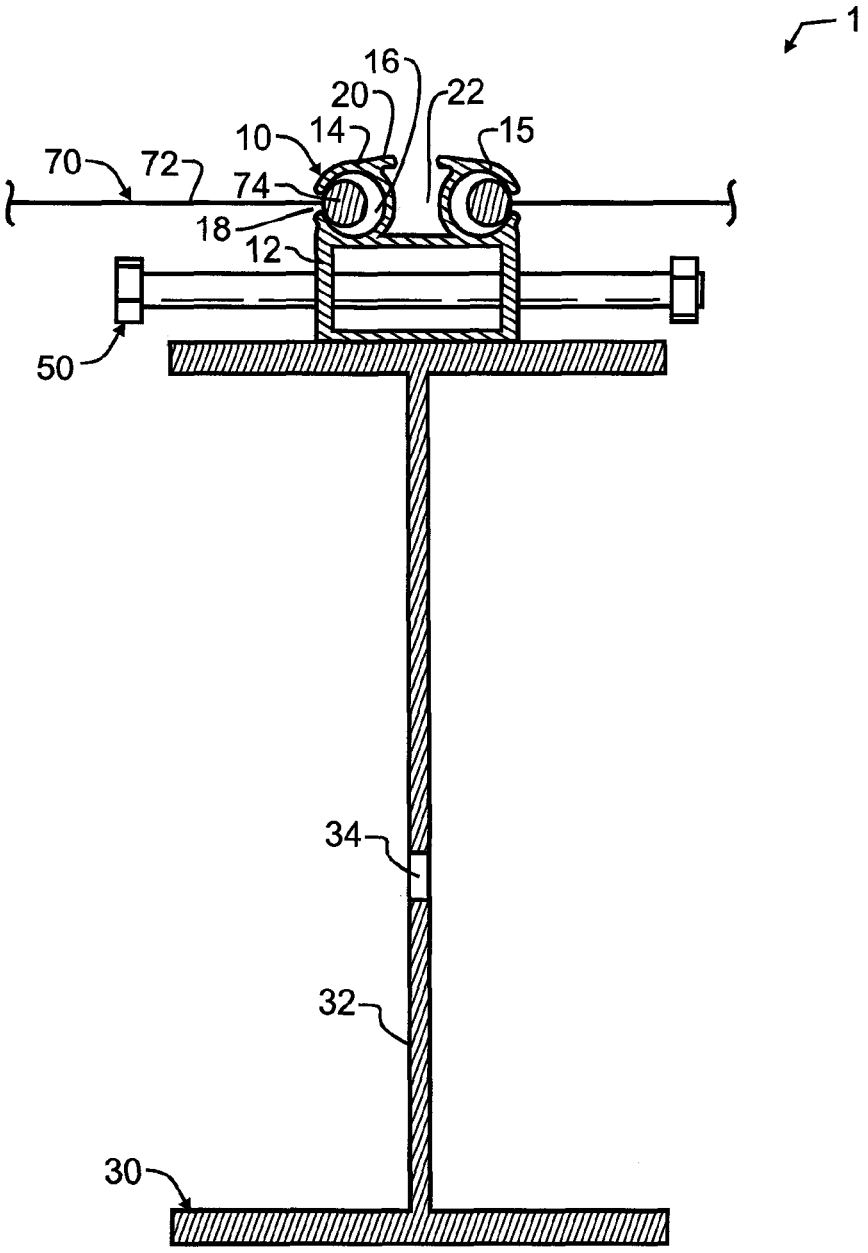
FIG. 1 illustrates a preferred embodiment keder rail attachment designed in accord with the teachings of the present invention from a front elevational and partial section view.

A preferred embodiment keder rail attachment 1 for a fabric or panel building designed in accord with the teachings of the present invention is illustrated in FIG. 1. Preferred embodiment keder rail attachment 1 has several primary components, including a keder rail 10, a support beam 30, a keder rail anchor 50, and a membrane 70.

A preferred embodiment keder rail 10 is comprised of a longitudinally extensive box or rectangular extrusion, referred to here as the base 12. Base 12 is preferably hollow in order to save material cost and reduce weight, but may be solid. Base 12 preferably has two protrusions 14, 15 on the top of base 12 that form longitudinal cylinders with a circular opening on each of the front and back ends, and each cylinder having one open slit 18 extending in the longitudinal direction. These cylindrical protrusions 14, 15 are collectively referred to herein below as the keder track. A membrane 70 is formed from a fabric 72 with a keder bead 74 forming the edge. Keder bead 74 is preferably inserted in the front or back circular openings of the keder track and slid in longitudinally with fabric 72 protruding through open slit 18, as can be seen in FIG. 1. When lateral pressure is applied to fabric 72, open slit 18 in the longitudinal surface of the keder track is too small to allow keder bead 74 to pull out. End caps may be placed on the front and back ends of the keder track after the keder bead 74 is inserted, if desired.

As described herein below, a keder rail clamp 90 may be used to attach keder rail 10 to a building's support beams 30 prior to keder bead 74 insertion. A tensioning tool 110, also described herein below, may be used to pull fabric 72 tight between keder rails 10 after keder bead 74 on each end of fabric 72 has been inserted. Tensioning tool 110 can then be used to pull one or both of keder rails 10 into position to be secured to support beam 30. In the preferred embodiment, the support beam is a known I-beam such as may be fabricated by welding or extrusion techniques, though as will become more apparent herein below and in accord with the teachings of the present invention, the support beam may assume other geometries or shapes.

In alternative embodiments contemplated herein, the keder track may be formed as intrusions rather than cylindrical protrusions 14, 15, or may be positioned on base 12 differently, such as but not limited to being positioned on a lateral surface rather than the top surface. The number of tracks may also vary, as may be best suited for different uses.

Figure 3:
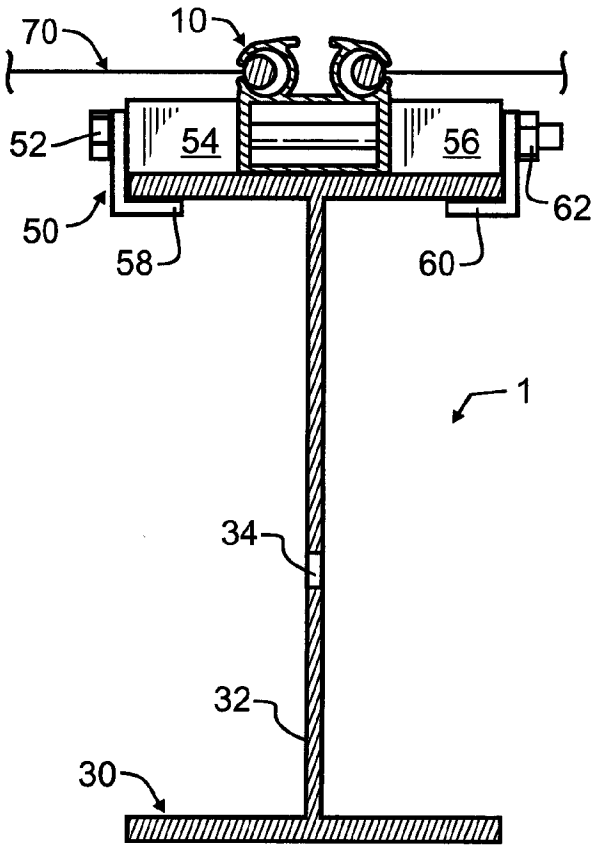
FIGS. 2 and 3 illustrate the preferred embodiment rail attachment of FIG. 1 as it may be attached to a support beam from a front elevational and partial section view to illustrate different attachment positions in greater detail.
Figure 2:
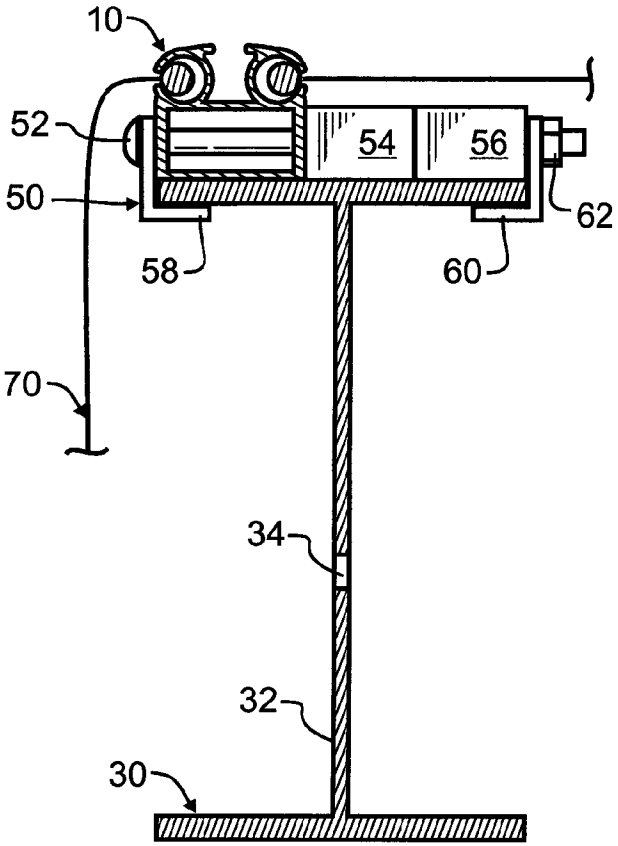
Figure 4:
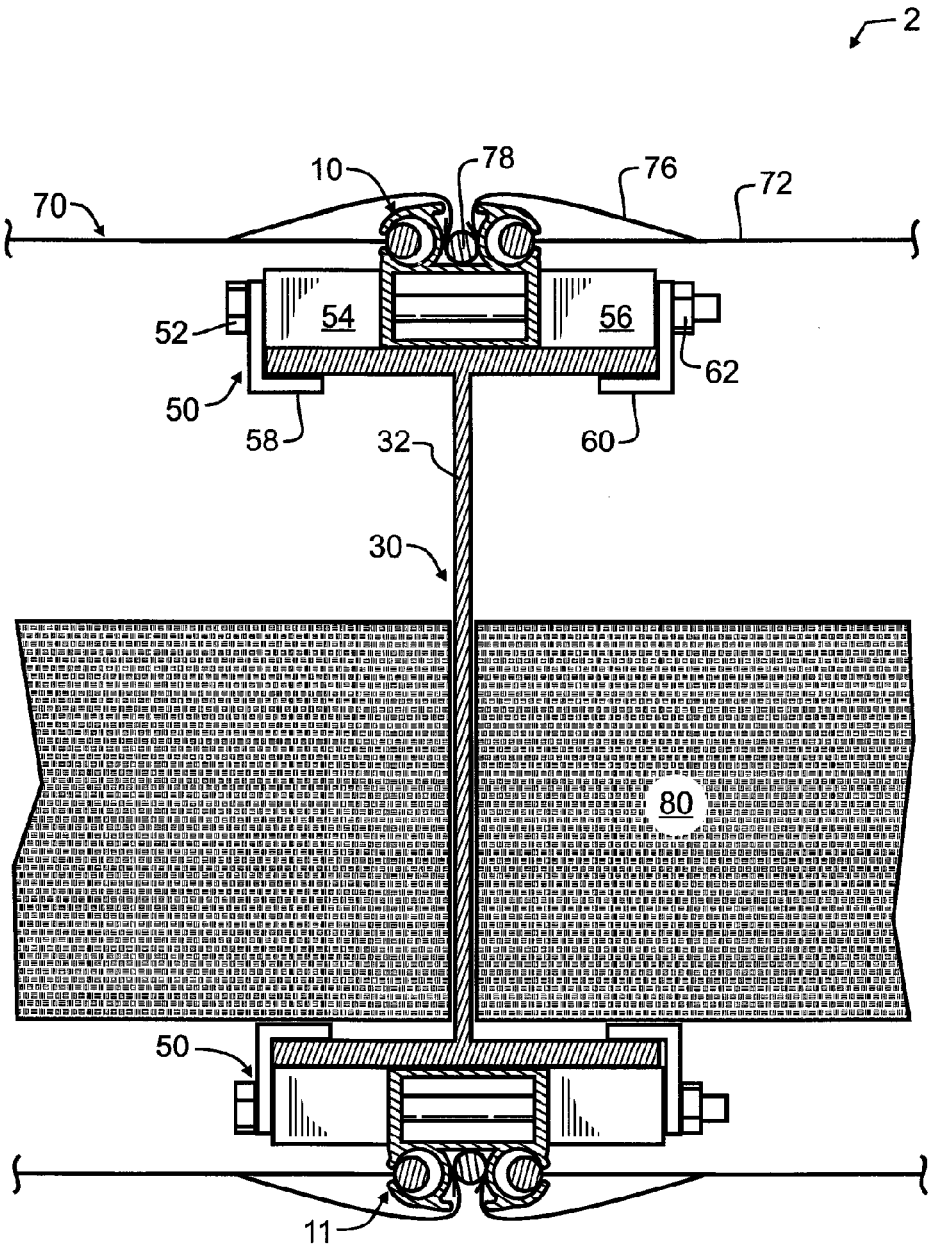
FIG. 4 illustrates an alternative embodiment barrier construction using the preferred embodiment keder rail attachment of FIG. 1, as used in an exemplary construction of an insulated building from a front elevational and partial section view.

As seen in FIGS. 1-3, keder rail flap hooks 20 protrude from cylindrical protrusions 14, 15. After the keder membrane 70 and keder rails 10 are installed, adjacent keder flaps 76 illustrated in FIG. 4 are preferably affixed to keder rail flap hooks 20 by inserting their ends in an overlapping fashion into keder rail longitudinal slot 22 and sealably retained therein by insertion of elastomeric bead 78 therein. This provides a dual seal to better isolate the building interior from the elements. Keder flaps 76 may be adhered or secured to fabric 72 using any suitable technique, may be loosely placed adjacent thereto, or may alternatively be formed from a single relatively more rigid formed or molded part such as taught by the Reynolds published applications or the Green patent incorporated by reference herein above.

One or more anchor bolts 52 preferably penetrate the lateral surfaces of the rectangular base 12, entering on one lateral surface and exiting through the other such as illustrated in FIG. 1. These anchor bolts 52 are preferably used to secure keder rail 10 to an underlying structure such as a support beam 30. While a bolt is preferred, other suitable fasteners may be incorporated as may be known in the fastener arts.

As can be seen in FIGS. 2 and 3, anchor bolt 52 will also preferably penetrate two securing angles 58, 60 that run perpendicular to anchor bolt 52 and from anchor bolt 52 down to below the top surface of support beam 30. These securing angles 58, 60 then form 90 degree angles to run along the underside of support beam 30. Securing angles 58, 60 are preferably on opposite lateral sides of support beam 30 so that they can grip support beam 30 when forces are applied from any direction. As a result, keder fabric 72 may be attached to a top surface, side surface, or even an angled surface of support beam 30 in any orientation, such as but not limited to the longitudinal side running parallel or perpendicular to the ground. Securing angles 58, 60 will hold keder rail 10 to beam 30 prior to anchor bolt 52 being tightened, which again means keder rail 10 will stay coupled to support beam 30, regardless of beam 30 orientation with respect to gravity. This means that there is an opportunity for adjustment of keder rail 10 relative to support beam 30, until keder rail 10 is firmly anchored by fully tightening anchor bolt 52. Such adjustment was not heretofore possible with TEK screws.

As can be seen in FIGS. 2 and 3, if keder rail 10 is not the same width as support beam 30, spacer blocks 54, 56 with holes for anchor bolt 52 may be placed on either side of keder rail 10, to fill the gap between keder rail 10 and securing angles 58, 60. When keder rail 10 is positioned at the edge of a support beam 30, as illustrated in FIG. 2, fabric 72 from cylindrical protrusion 14 may travel vertically down or at some direction offset between vertical and horizontal while fabric 72 from the opposite cylindrical protrusion 15 may travel outwards in a horizontal plane. This allows keder fabric 72 to form a corner on a structure without requiring any special equipment. Preferably, the anchor bolt heads would be located on the side with fabric 72 traveling in a vertical plane in order to minimize tears in the fabric 72. A rounded anchor bolt head as illustrated will further reduce fabric strain. Even though a 90-degree angle is shown here between the two fabrics 72, the fabric 72 may travel in any direction as is supported by the structure's design and the location of open slits 18 in keder rail 10.

In the position illustrated in FIG. 3, spacer blocks 54, 56 may be placed on each side of keder rail 10, centering keder rail 10 on support beam 30. The keder fabric 72 would preferably travel in lateral directions, but could also travel in an upward or downward angle, as is allowed by the width of support beam 30 and anchor bolts 52.

While spacer blocks 54, 56 are described here, the invention is not limited to such an implement. Alternatively, other devices may be used. For exemplary purposes, but not solely limiting the invention thereto, a "U"-shaped device may be used that connects to the bolt, projects laterally to the edge of the support beam 30, curves around and under the support beam 30, and then continues a short way before terminating. Other suitable apparatus known in the hardware arts may also be used.

FIG. 4 illustrates an alternative keder rail attachment 2 in accord with the present invention with two opposed keder rails 10, 11. Keder rail 11 will be understood to include features and adjunct components similar to or identical to those of keder rail 10 already discussed herein above. The keder rails 10, 11 are secured to the interior and exterior surfaces of a building support beam 30 and fabric 72 is installed on both the interior and exterior surfaces using keder rails 10, 11 on opposed surfaces of support beams 30. Additional insulation 80 may optionally be installed between the spaced layers of keder fabric 72. In this embodiment, the interior and exterior layers of keder fabric 72 isolate insulation 80 from both the building interior and exterior. Keder flaps 76 and elastomeric beads 78 help ensure this isolation.

Figure 5:
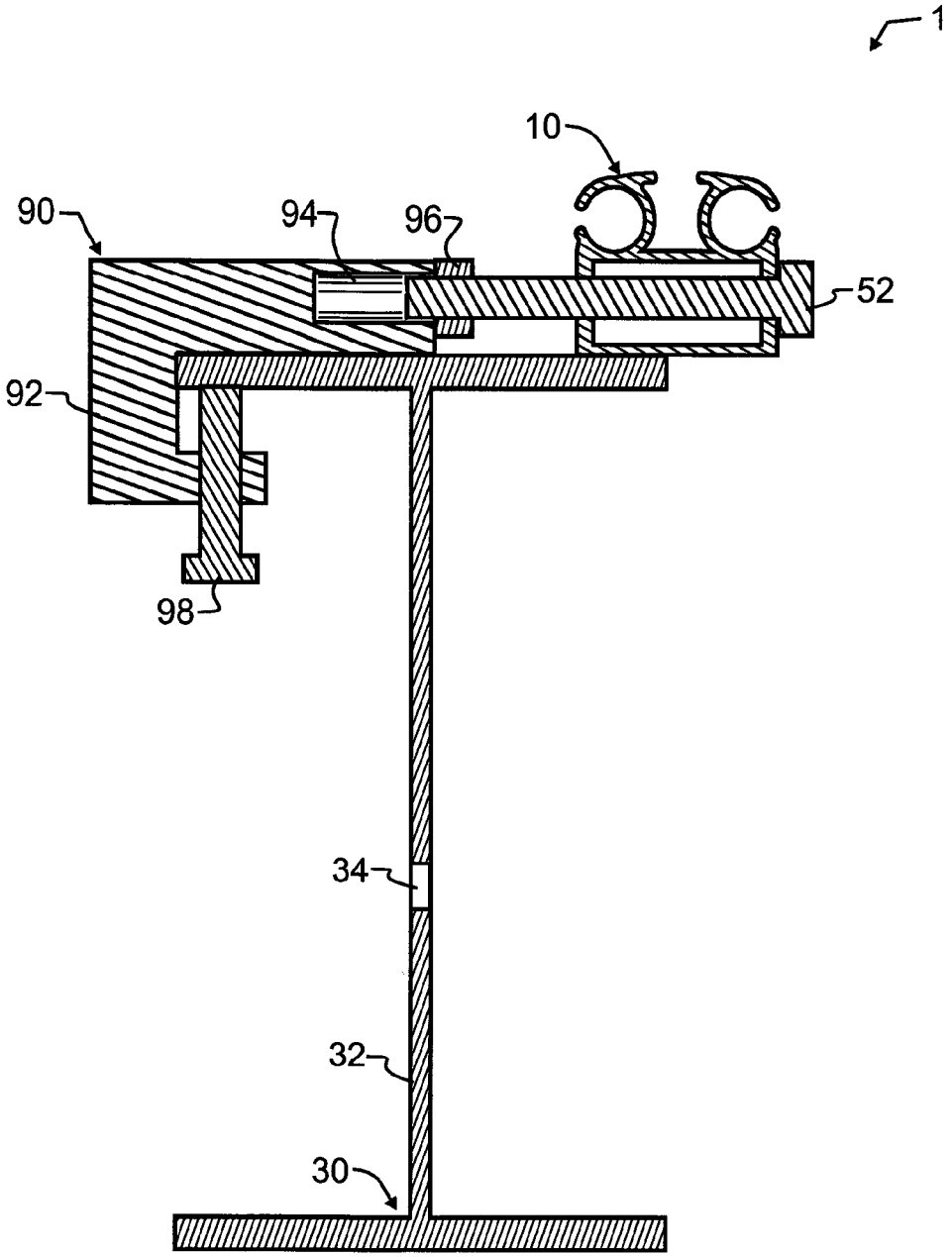
FIG. 5 illustrates a preferred embodiment keder rail clamp in combination with the preferred embodiment rail attachment of FIG. 1 from a front elevational and partial section view.

As illustrated in FIG. 5, a preferred embodiment keder rail clamp 90 consists of a body 92 defining a horizontal region with a hole 94 for anchor bolt 52 insertion, a 90 degree angle to form a vertical surface adjacent to the edge of support beam 30, and another 90 degree angle in the opposite direction to wrap underneath the support beam 30 edge. The latter edge preferably contains a clamp bolt 98 to secure keder rail clamp 90 to support beam 30. Instead of the prior art method of attaching keder rail 10 to the building's frame while on the ground, in accord with the teachings of the present invention keder rail 10 is preferably affixed to a building's already constructed support frame using keder rail clamps 90 of FIG. 5. This is easily accomplished by screwing anchor bolts 52 into threaded openings or nuts 96. Keder rail 10 is positioned on the edge of support beam 30, rather in the center, to shorten the distance between the illustrated keder rail 10 and the previous adjacent keder rail 10. This allows keder beads 74 to be inserted into cylindrical protrusions 14, 15 of keder rail 10 without any tension in fabric 72. Next, the keder fabric 72 will need to be tensioned.

Figure 6:
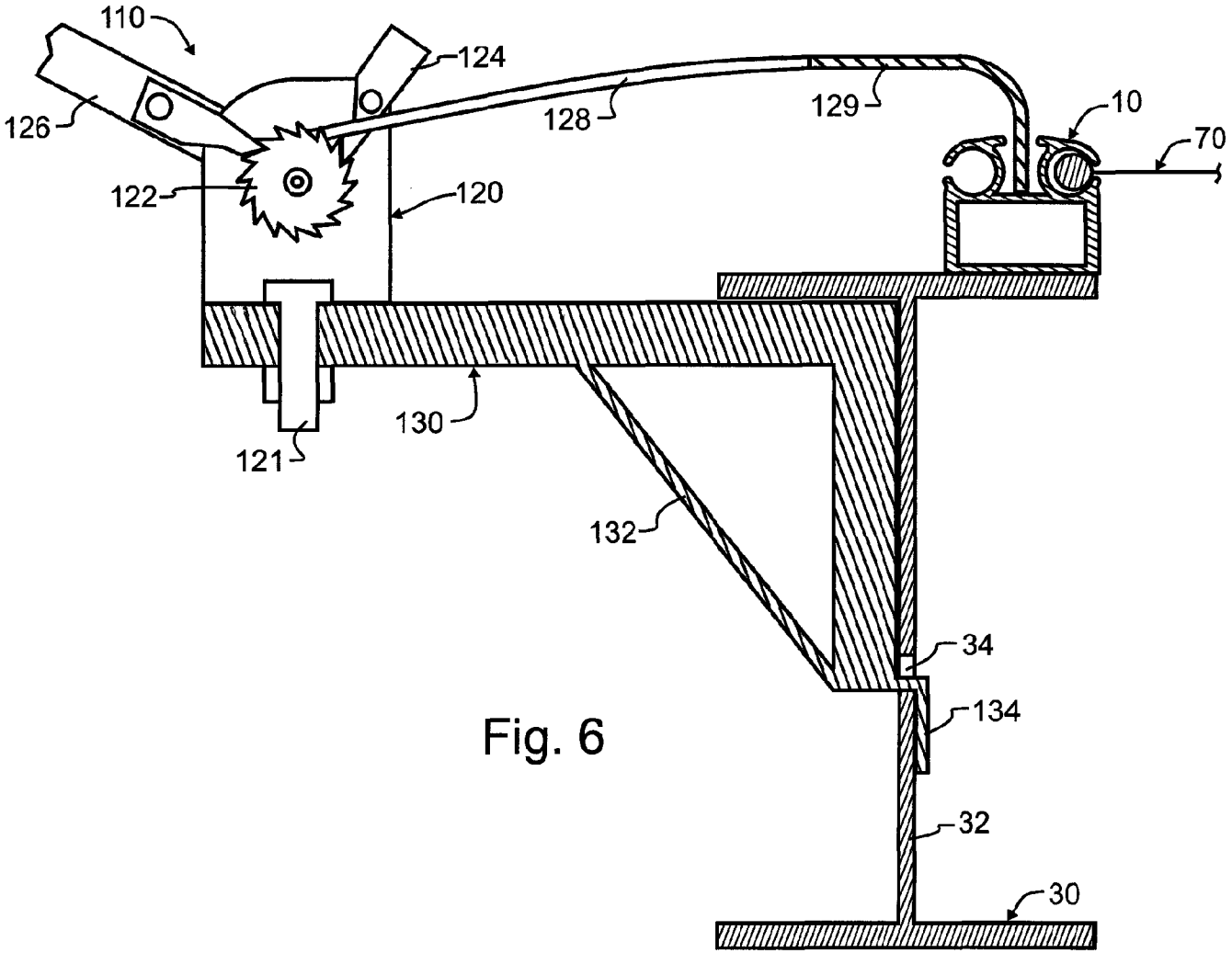
FIG. 6 illustrates a preferred embodiment tensioning device in combination with the preferred embodiment rail attachment of FIG. 1 from a front elevational and partial section view.

FIG. 6 illustrates a preferred embodiment tensioning tool 110 that may be used to pull fabric 72 tight between keder rails 10 after the keder bead 74 on each end of fabric 72 has been inserted. Tensioning tool 110 will preferably be used to pull keder rail 10 into position to be secured to support beam 30, and will in this same process tension fabric 72. Preferred embodiment tensioning tool 110 consists of a winch 120 secured through a bolt 121 to a right angle brace bar 130 having an optional strengthening spanner bar 132 that forms a 45 degree angle across right angle brace bar 130, and an anchor tongue 134. Tensioning tool 110 may be made of any suitably strong material to withstand the forces necessary while remaining narrow in design. Steel is an exemplary material.

As seen in FIGS. 5 and 6, support beams 30 preferably have small slots 34 pre-cut in beam vertical 32, for exemplary purposes at two foot intervals, to allow anchor tongue 134 of tensioning tool 110 to be inserted through. Only one slot 34 is needed per tensioning tool 110. The tensioning tool dimensions are preferably designed to fit the distance from slot 34 to the edge of support beam 30 without extra space so that when tension is applied, both the horizontal and the vertical surfaces of support beam 30 reinforce tensioning tool 110 in order to prevent undue stress on tensioning tool 110. While a slot 34 is preferred owing to the simplicity of machining in standard beams, it will be understood herein that other methods of coupling tensioning tool 110 to support beams 30 are contemplated herein, and may, for exemplary purposes, include the provision of a pocket on vertical 32 into which anchor tongue 134 may be received. Other suitable methods of removable coupling as are known in the fastener arts are contemplated herein.

As seen in FIG. 6, a hook 129 and strap 128 are preferably secured to keder rail 10 in keder rail longitudinal slot 22 between cylindrical protrusions 14, 15. Strap 128 is fed around winch 120. A person will rotate winch handle 126 which turns ratchet 122, causing anti-reversing pawl 124 to click over ratchet 122 teeth. This wraps strap 128 about ratchet 122, shortening the distance between winch 120 and keder rail 10. As the winch turns and shortens strap 128, tensioning tool 110 is lifted, pivoting around the anchor in the support beam slot. Once brace bar 130 is flush with the support beam 30, further tightening of winch 120 applies lateral tension to keder rail 10 to displace keder rail 10. Hook 129 is preferably made of metal, such as aluminum or steel, but can be made of any suitable material that is strong enough to handle strong forces without bending or breaking. The strap 128 may for exemplary purposes be fabricated from a strong fabric, such as the kind used for seat belts and commercially available ratchet straps.

Figure 7:
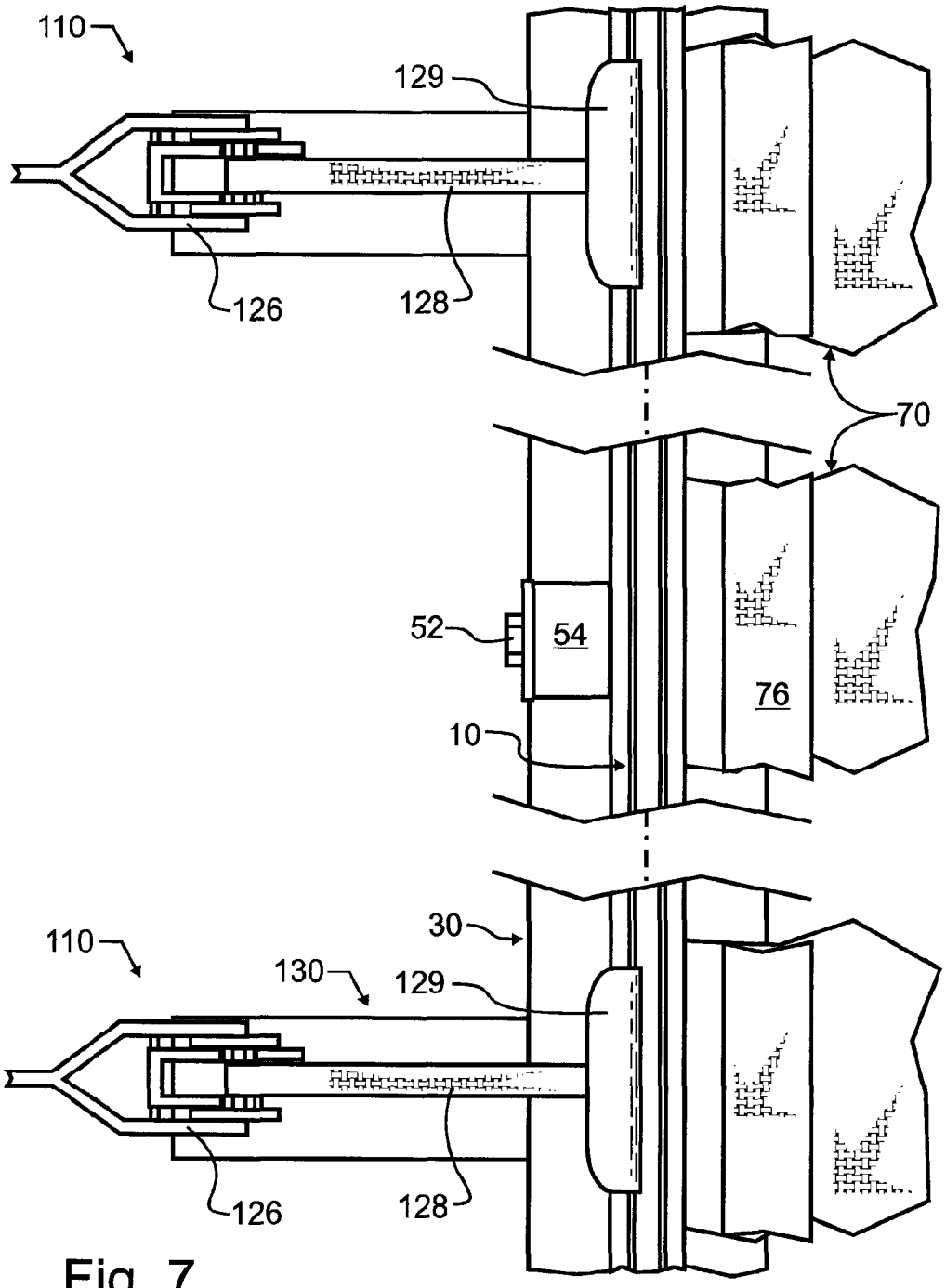
FIG. 7 illustrates the preferred embodiment tensioning device in combination with the preferred embodiment rail attachment of FIG. 1 from a top view.

Preferably, two tensioning tools 110 are used in two consecutive slots 34 simultaneously, and tensioning begins on one lateral end of keder rail 10. FIG. 7 illustrates this process. When the keder rail 10 is in position, it is secured as illustrated in FIGS. 2, 3 and 7 by affixing keder rail anchor bolt 52 and securing angles 58, 60. Slots 34 and anchor bolt holes may not line up because the distance between anchor bolt holes depends on structural design specifications such as wind load.

Once keder rail anchor bolt 52 and securing angles 58, 60 are installed and tightened, the most lateral tensioning tool 110 is preferably released and moved to the slot that is medially concurrent to the other tensioning tool 110. The tensioning tools 110 are again adjusted until keder rail 10 is in the desired position. Again, an anchor bolt 52 is installed in the anchor bolt hole between the two tensioning tools 110, and the most lateral tensioning tool 110 is released and is inserted into the slot that is medially concurrent to the more medial tensioning tool 110. This process is repeated until the entire keder rail 10 has been tensioned and clamped. The clamps 90 of FIG. 5 may be replaced with the securing angles 58, 60 and spacer blocks 54, 56 illustrated in FIGS. 2 and 3, or with any other securing methods obvious to one familiar with the field.

While a preferred keder rail 10 is fabricated from a metal extrusion and the fasteners will typically comprise corrosion-resistant, plated, or coated metals, the components illustrated herein and alternatives or equivalents thereto may be manufactured from a variety of materials, including metals, resins and plastics, ceramics or cementitious materials, or even combinations or composites of the above. The specific material used may vary, though special benefits are attainable if several important factors are taken into consideration. First, a preferred material will offer corrosion resistance to avoid adverse weathering and aging due to condensation and other vagaries of weather. Furthermore, it is preferable that all materials are sufficiently tough and durable to not fracture, even when great forces are applied thereto.

While the foregoing details what is felt to be the preferred embodiment of the invention, no material limitations to the scope of the claimed invention are intended. Further, features and design alternatives that would be obvious to one of ordinary skill in the art are considered to be incorporated herein. For exemplary purposes only, and not solely limiting thereto, the cylindrical protrusions 14, 15 may comprise any suitable geometry, and so will be understood broadly to comprise longitudinally open bodies each having a longitudinally extending open slit. As may be apparent then, the scope of the invention is set forth and particularly described in the claims hereinbelow.

I claim:

1. In combination, a keder rail, support beam and keder rail attachment, said keder rail comprising:

a base;

two longitudinally open bodies each having one open slit extending in the longitudinal direction; and a longitudinally extensive slot between said two longitudinally open bodies;

said keder rail attachment comprising:

a fastener affixed laterally through said keder rail base; and couplers extending between said fastener and said support beam;

wherein said couplers further comprise two securing angles that each are distally located about said support beam.

2. The combination keder rail, support beam and keder rail attachment of claim 1, wherein said base further comprises a rectangular hollow extrusion.

3. The combination keder rail, support beam and keder rail attachment of claim 1, wherein said two longitudinally open bodies further comprise longitudinal cylinders.

4. The combination keder rail, support beam and keder rail attachment of claim 1, wherein said fastener passes through each of said two securing angles, and may be tightened thereabout to secure to said support beam.

5. The combination keder rail, support beam and keder rail attachment of claim 1, wherein said support beam further comprises an I-beam.

6. The combination keder rail, support beam and keder rail attachment of claim 5, wherein said support beam further comprises a plurality of slots formed in said I-beam through which a tensioning anchor tongue may operatively be received.

* * * * *